United States Patent [19]

DuBois et al.

[11] 4,294,780

[45] Oct. 13, 1981

[54] TEMPERATURE COMPENSATOR FOR A CARBURETOR CHOKE VALVE

[75] Inventors: Chester G. DuBois, Zion; Richard P. Hulsebus, Waukegan, both of Ill.

[73] Assignee: Outboard Marine Corporation

[21] Appl. No.: 134,065

[22] Filed: Mar. 26, 1980

[51] Int. Cl.[3] ..... F02M 1/10

[52] U.S. Cl. ..... 261/39 B; 261/64 E; 251/286

[58] Field of Search ..... 261/39 B, 64 E; 251/286, 284

[56] References Cited

U.S. PATENT DOCUMENTS

| | | | |
|---|---|---|---|
| 1,863,715 | 6/1932 | Heitger | 261/39 B |
| 1,881,558 | 10/1932 | Heitger | 261/39 B |
| 2,122,773 | 7/1938 | Hammond | 261/64 E |
| 2,578,076 | 12/1951 | Kirby | 251/284 |
| 2,798,690 | 7/1957 | Nelson et al. | 251/284 |
| 3,248,675 | 4/1966 | Furbacher | 261/39 B |
| 3,960,133 | 6/1976 | Donovan | 251/286 |
| 4,211,734 | 7/1980 | Cheng | 261/39 B |

*Primary Examiner*—Tim R. Miles

*Attorney, Agent, or Firm*—Michael, Best & Friedrich

[57] ABSTRACT

A carburetor comprises an air induction passage and a choke valve movable in the air induction passage between a fully closed position and a range of positions advanced of the fully closed position. A predetermined second position of the choke valve is located within this range of positions. A stop mechanism is selectively movable into and out of the path of movement of the choke valve of prevent and permit choke valve movement from its second position toward its fully closed position. A thermo-sensitive element controls the movement of the stop mechanism such that the stop mechanism is disposed in the path of choke valve movement whenever the ambient temperature around the carburetor exceeds a predetermined level.

4 Claims, 3 Drawing Figures

TEMPERATURE COMPENSATOR FOR A CARBURETOR CHOKE VALVE

FIELD OF THE INVENTION

The invention generally relates to carburetors for internal cumbustion engines and, more particularly, to carburetor choke valves.

DESCRIPTION OF THE PRIOR ART

Attention is directed to the following United States Patents which generally disclose carburetors and other fuel control devices for internal cumbustion engines:

| | | |
|---|---|---|
| Fulton | 1,145,476 | July 6, 1915 |
| Fulton | 1,165,087 | December 21,1915 |
| Fulton | 1,203,601 | November 7, 1916 |
| Heren | 1,243,602 | October 16, 1917 |
| Heitger | 1,968,553 | July 31, 1934 |
| Weber | 2,062,260 | November 24, 1936 |
| Hunt | 2,102,846 | December 21, 1937 |
| Farrell | 2,110,211 | March 8, 1938 |
| Bracke | 2,182,580 | December 5, 1939 |
| Dermond | 2,873,958 | February 17, 1959 |
| Smitley | 2,970,825 | February 7, 1961 |
| Moseley | 3,006,617 | October 31, 1961 |
| Reppert | 3,030,027 | April 17, 1962 |
| Lucas | 3,058,727 | October 16, 1962 |
| Furbacher | 3,248,675 | April 26, 1966 |
| Sagady | 3,278,119 | October 11, 1966 |
| Sweeny | 3,432,152 | March 11, 1969 |
| Gele, et al | 3,721,428 | March 20, 1973 |
| Jones | 3,726,511 | April 10, 1973 |

Carburetors having thermo-sensitive members which control the richness of the fuel-air mixture supplied to the combustion chamber are known. In Heren, for example, a thermo-sensitive member controls the position of a needle valve which is in line with the fuel outlet port of the carburetor. In Bracke, the carburetor includes a series of thermo-sensitive air valves. In Reppert and Dermond, thermo-sensitive air bleed controls are utilized. In other constructions, the thermo-sensitive member is carried by the carburetor choke valve (such as in Heitger, Weber, Hunt, and Farrell). Alternately, the thermo-sensitive member is operatively connected with the choke valve by linkage system (such as in Fulton, Smitley, Moseley, Lucas, Furbacher, and Sagady).

Carburetors having non-thermo-sensitive members to control the richness of combustible fuel delivered to the combustion chamber are also known (Gele, Sweeney, and Jones).

SUMMARY OF THE INVENTION

The invention provides a carburetor comprising an air induction passage and a choke valve movable in the air induction passage between a first position and a range of positions spaced from the first position. The range of positions includes therein a second position of the choke valve. Stop means is movable between a position extending into the path of choke valve movement for preventing movement of the choke valve from its second position toward its first position and a position retracted from the path of choke valve movement for permitting movement of the choke valve between its first position and its range of positions. Activation means is operatively connected with the stop means for controlling movement of the stop means between its extended position and its retracted position.

In one embodiment of the invention, the activations means includes means operative in response to changes in temperature for moving the stop means between its extended position and its retracted position.

In one embodiment of the invention, the carburetor further includes a housing through which the air induction passage extends. In this embodiment, the stop means includes means for defining an opening in the housing along the path of movement of the choke valve and in general alignment with the second position of the choke valve. The stop means further includes a pin movable in the opening into and out of the path of movement of the choke valve.

In one embodiment of the invention, the stop means includes means operative when the stop means is in its extended position for permitting movement of the choke valve from its first position to and beyond its second position.

One of the principal features of the invention is a carburetor which has a choke valve and which includes a stop mechanism which is selectively movable into the path of movement of the choke valve for preventing the return of the choke valve to its fully closed position.

Another one of the principal features of the invention is the provision of a carburetor having a choke valve which is prevented from returning to its fully closed position when ambient temperatures in excess of a predetermined temperature prevail.

Other features and advantages of the embodiments of the invention will become known by a reference to the following general description, claims, and drawings.

DRAWINGS

Figure 1:
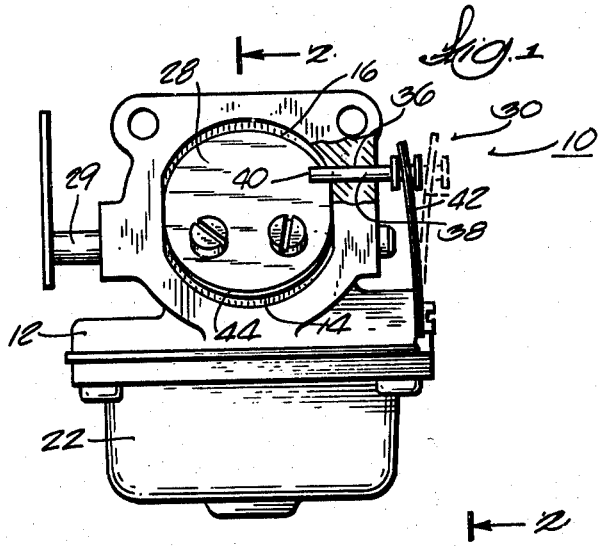
FIG. 1 is a top and partially broken away view of a carburetor which embodies various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

GENERAL DESCRIPTION

Figure 2:
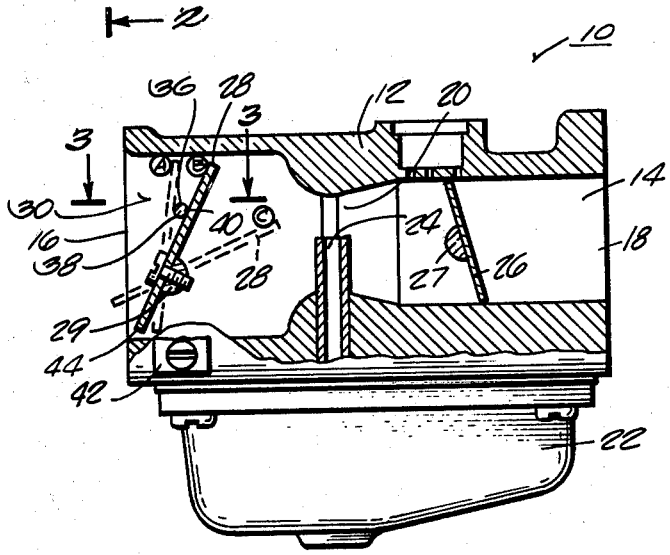
FIG. 2 is a section view of the carburetor generally taken along line 2—2 of FIG. 1.

Shown in the drawings is a carburetor 10 which includes a housing 12 and an air induction passage 14 extending through the housing 12 (as can be best seen in FIG. 2). The air induction passage 14 includes an inlet end 16 which is open to the atmosphere and an outlet end 18 which may communicate by various means with the combustion chamber of an engine (not shown). In the illustrated embodiment (see FIG. 2), a venturi 20 is located between the inlet and outlet ends 16 and 18 of the air induction passage 14.

In the illustrated embodiment, and still referring principally to FIG. 2, the carburetor 10 also includes a fuel chamber 22 which communicates with a source of fuel (not shown) and with the air induction passage 14 by means of a fuel orifice 24 in the venturi 20. During operation of the engine with which the carburetor 10 is adapted for use, air is drawn from the atmosphere through the inlet end 16 of the air induction passage 14 and draws fuel from the fuel chamber 22 through the orifice 24 into the air induction passage 14. The resultant air-fuel mixture is delivered to the combustion chamber of the engine for ignition.

By controlling the volume of air which is drawn through the air induction passage, engine speed and overall engine performance can be regulated. A throttle valve 26 and a choke valve 28 are located in the air induction passage 14 for this purpose.

More particularly, each of the throttle valve 26 and the choke valve 28 is carried on a shaft, respectively 27 and 29, for pivotal movement in the air induction passage 14. The throttle valve 26 is located for movement downstream of the venturi 20, and the choke valve 28 is located for movement upstream of the venturi 20.

Referring now principally to the operation of the choke valve 28, and as can be seen in FIG. 2, the choke valve 28 is movable in the air induction passage 14 between a first or fully closed position (shown as phantom line position A in FIG. 2) and a range of positions up to and including a fully opened position (shown as phantom line position C in FIG. 2).

Pivotal movement of the choke valve 28 between its fully closed and fully opened positions can be controlled manually or automatically in accordance with conventional practice, and the invention is applicable regardless of the particular choke valve control mechanism employed.

When the engine with which the carburetor 10 is adapted for use is started from cold, the choke valve 28 is typically moved to its first or fully closed position (phantom line position A in FIG. 2). This substantially blocks the flow of air through the air induction passage, and a relatively rich air-fuel mixture is formed. After the engine has reached its desired operational temperature, the choke valve 28 is typically moved to its fully opened position (phantom line position C in FIG. 2), so that a leaner fuel mixture more suited for warm engine operations is supplied.

When the engine is warm, or when relatively high ambient temperatures otherwise prevail around the carburetor 10, it may not be desirable to start the engine with the choke valve 28 in its fully closed position (phantom line position A in FIG. 2), because, during conditions of relatively high ambient temperatures, a rich fuel-air mixture could flood the engine or otherwise adversely affect engine performance. Thus, it is desirable during warm starting of the engine to prevent full closure of the choke valve 28 so that a leaner fuel mixture is supplied.

To selectively prevent the return of the choke valve 28 toward its fully closed position in the illustrated embodiment, the carburetor 10 includes stop means 30 which is selectively movable into the path of movement of the choke valve 28. When so positioned, the stop means 30 prevents movement of the choke valve 28 from a preselected second position located within the range of choke valve positions (shown as solid line position B in FIG. 2) toward its fully closed position (phantom line position A in FIG. 2). When the choke valve 28 is located in its second position, more air can flow through the air induction passage than when the choke valve 28 is fully closed, and the fuel-air mixture is thus leaner.

While the stop means 30 may be variously constructed, in the illustrated embodiment (see FIG. 1), the stop means 30 includes an opening 36 in the housing 12 along the path of movement of the choke valve 28. As can be seen in FIG. 2, the opening 36 is generally aligned wih the desired second position of the choke valve 28.

In this construction, the stop means 30 further includes a pin 38 or the like having an end portion 40. The pin 38 is slidably movable in the opening 36 between an extended position into and retracted position from the air induction passage 14. More particularly, when the pin 38 is in its extended position (as shown in solid lines in FIG. 1), the end portion 40 is positioned outwardly beyond the opening 36 and in the path of movement of the choke valve 28. As can be seen in solid lines in FIG. 2, when the pin 38 is so positioned, the end portion 40 of the pin 38 blocks movement of the choke valve 28 from its second position (solid line position B in FIG. 2) toward its fully closed position (phantom line position A in FIG. 2).

When the pin 38 is in its retracted position (shown in phantom lines in FIG. 1), the end portion 40 is positioned within the opening 36 and out of the path of movement of the choke valve 28. When the pin 38 is so positioned, movement of the choke valve 28 in the air induction passage 14 is unimpeded.

The carburetor also includes activating means 42 (see FIG. 1) which is operatively connected with the pin 38 for controlling movement of the pin 38 into and out of the path choke valve movement.

The activation means 42 may be variously constructed. For example, the pin 38 may be manually movable by the operator by means of a suitable linkage assembly (not shown) between its extended and retracted positions. In the illustrated embodiment (see FIG. 2), the activation means 42 takes the form of a bimetal strip or the like which is automatically operative in response to changes in temperature for moving the pin 38 between its extended position and its retracted position.

More particularly, in the illustrated embodiment, the bimetal strip 42 normally biases the pin 38 toward its retracted position (as shown in phantom lines in FIG. 1) and moves the pin 38 from its retracted position toward its extended position against the biasing force (as shown in solid lines in FIG. 1) when the ambient temperature exceeds a predetermined level. The bimetal strip 42 thereafter maintains the pin 38 in its extended position (shown in solid lines in FIG. 1) as long as the ambient temperature remains in excess of the predetermined temperature.

The exact location of the second position of the choke valve 28 in advance of its fully closed position may vary according to the operational demands of the particular carburetor or engine involved. Regardless of the particular location of the second position, it is desirable to selectively prevent movement of the choke valve 28 from its second position only in the direction toward its fully closed position (phantom line position A in FIG. 2). It is not desirable to otherwise interfere with choke valve movement in the opposite direction towards its fully opened position (phantom line position C in FIG. 2). In particular, it is not desirable to block choke valve movement from its fully closed position to its fully opened position whenever the pin 38 is extended.

When the second position is only slightly advanced from the first or fully closed position, the diameters of the pin 38 and opening 36 can be designed so that, when the pin 38 is retracted, the outer side edge 44 of the choke valve 28 covers the opening 36 whenever the choke valve 28 is located anywhere between its fully closed position and its second position. Thus, in this embodiment, movement of the pin 38 from its retracted position within the opening 36 to its extended position is blocked by the outer side edge 44 of the choke valve 28 until the choke valve 28 is at or beyond its second position. Thus, in this embodiment, movement of the choke valve 28 from its fully closed position beyond its second position is never impeded by the pin 38.

Figure 3:
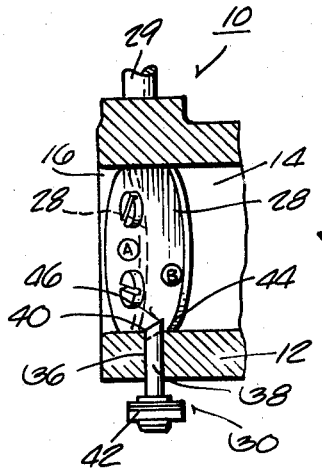
FIG. 3 is a section view of the carburetor taken generally along line 3—3 of FIG. 2.

However, when the second position is farther advanced from the fully closed position, it is possible for the pin 38 to be moved by the bimetal strip 42 into its extended position during a time when the choke valve 28 is located between its fully closed and second positions. The pin 38 would thereafter block movement of the choke valve 28 from its fully closed position beyond its second position. To prevent such occurrence in this embodiment (see FIG. 3), the stop means 30 further includes means 46 operative when the pin 38 is in its extended position for permitting movement of the choke valve 28 in the direction from its fully closed position to and beyond its second position, while preventing movement of the choke valve 28 in the opposite direction from its second position toward its fully closed position.

In the illustrated embodiment (see FIG. 3), the means 46 takes the shape of a ramp or the like formed on the end portion 40 of the pin 38. The ramp 46 is progressively sloped in the direction of choke valve movement from its fully closed position toward its second position. By virtue of this construction, when the pin 38 is in its extended position, movement of the choke valve 28 in the direction from its fully closed position (phantom line position A in FIG. 3) toward its second position (solid line position B in FIG. 3) causes the outer side edge 44 of the choke valve 28 to slide along the progressively sloped incline of the ramp 46. The pin 38 is thus moved against the bias of the bimetal strip 42 toward its retracted position, until the outer side edge 44 of the choke valve 28 clears the pin 38, thereby assuming its second position. At this time, the bias of the bimetal strip returns the pin 38 toward its extended position, and subsequent movement of the choke valve 28 in the direction from its second position toward its fully closed position is prevented by the pin 38 until the pin 38 retracts. Alternately, in a construction which is not shown, the outer side edge 44 of the choke valve 28 itself may be sloped to achieve the same operative affect.

Various of the features of the invention are set forth in the following claims.

We claim:

1. A carburetor comprising an air induction passage, a choke valve movable in said air induction passage between a first position and a range of positions spaced from said first position and including within said range of positions a second position of said choke valve, a pin movable between a first pin position extending into the path of choke valve movement for preventing movement of said choke valve from said choke valve second position toward said choke valve first position and a second pin position retracted from the path of choke valve movement for permitting movement of said choke valve between said choke valve first position and said range of choke valve positions, and thermostatic activation means operatively connected with said pin for controlling movement of said pin between said extended position and said retracted position.

2. A carburetor according to claim 1 wherein said pin includes means operative when said pin is in said extended position for permitting movement of said choke valve from said first position to and beyond said second position while preventing movement of said choke valve from said second position toward said first position.

3. A carburetor according to claim 1 or 2 wherein said activation means includes means for biasing said pin toward said retracted position and means for moving said pin from said retracted position toward said extended position against the action of said biasing means when the ambient temperature exceeds a predetermined temperature and for maintaining said pin in said extended position when the ambient temperature is in excess of the predetermined temperature.

4. A carburetor according to claim 1 or 2 and further including a housing through which said air induction passage extends, and means defining an opening in said housing through which said pin moves, said opening being in general alignment with said second position of said choke valve, and wherein said pin includes an end portion extending outwardly beyond said opening into said air induction passage and in the path of movement of said choke valve when said pin is in said extended position and located in a generally retracted position within said opening and out of the path of movement of said choke valve when said pin is in said retracted position.

* * * * *